US010529265B2

(12) United States Patent
Kim et al.

(10) Patent No.: US 10,529,265 B2
(45) Date of Patent: Jan. 7, 2020

(54) DISPLAY DEVICE AND METHOD OF DRIVING THE SAME

(71) Applicant: SAMSUNG DISPLAY CO., LTD., Yongin-si, Gyeonggi-do (KR)

(72) Inventors: Kyung-Man Kim, Seoul (KR); Su-Jin Seo, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 254 days.

(21) Appl. No.: 15/208,407

(22) Filed: Jul. 12, 2016

(65) Prior Publication Data

US 2017/0032723 A1 Feb. 2, 2017

(30) Foreign Application Priority Data

Jul. 29, 2015 (KR) ..... 10-2015-0107003

(51) Int. Cl.
*G09G 3/00* (2006.01)
*G09G 3/3266* (2016.01)
*G09G 3/3275* (2016.01)

(52) U.S. Cl.
CPC ..... *G09G 3/006* (2013.01); *G09G 3/3266* (2013.01); *G09G 3/3275* (2013.01); *G09G 2310/08* (2013.01); *G09G 2320/041* (2013.01); *G09G 2320/043* (2013.01)

(58) Field of Classification Search
CPC .... G09G 3/006; G09G 3/3266; G09G 3/3275; G09G 2310/08; G09G 2320/041; G09G 2320/043
See application file for complete search history.

(56) References Cited

U.S. PATENT DOCUMENTS

2010/0265228 A1* 10/2010 Kimura ..... G09G 3/3233 345/207
2013/0147693 A1* 6/2013 Bae ..... G09G 3/3208 345/82
2015/0130866 A1* 5/2015 Bae ..... G09G 3/3225 345/694
2015/0379940 A1* 12/2015 Kishi ..... G09G 3/3225 345/690

FOREIGN PATENT DOCUMENTS

KR 10-2011-0028752 A 3/2011
KR 10-2014-0082498 A 7/2014
KR 10-2016-0055558 A 5/2016

* cited by examiner

*Primary Examiner* — Towfiq Elahi
(74) *Attorney, Agent, or Firm* — Lewis Roca Rothgerber Christie LLP

(57) ABSTRACT

A display device includes a display panel, a scan driver that provides a scan signal to the display panel, a data driver that provides a data signal to the display panel, a driving controller that controls the scan driver and the data driver, a temperature sensor that senses local temperatures of local regions of the display panel using a temperature sensor and generates temperature sensing information, a current sensor that senses driving currents of the local regions and generates current sensing information, and a sensing controller that selects sensing target regions based on respective degradation degrees of the local regions, determines sensing priorities between the sensing target regions, and controls the sensing target regions to be sequentially sensed only during a sensing execution time according to the sensing priorities between the sensing target regions.

20 Claims, 13 Drawing Sheets

DISPLAY DEVICE AND METHOD OF DRIVING THE SAME

CROSS-REFERENCE TO RELATED APPLICATION

This application claims priority under 35 USC § 119 to Korean Patent Application No. 10-2015-0107003, filed on Jul. 29, 2015 in the Korean Intellectual Property Office (KIPO), the content of which is incorporated herein in its entirety by reference.

BACKGROUND

1. Field

Example embodiments of the present invention relate generally to a display device and a method of driving the same.

2. Description of the Related Art

Recently, organic light emitting display devices that include a plurality of pixels, each having an organic light emitting diode, have been widely utilized as display devices for consumer electronic products. However, because the pixels included in organic light emitting display devices may become degraded (or, deteriorated) as the organic light emitting display devices are utilized for a long period of time, organic light emitting display devices may perform degradation compensation for the display panel in order to control or compensate for degraded pixels in order to implement the same luminance as a non-degraded pixel under the same condition.

Thus, organic light emitting display devices may perform the degradation compensation for the display panel based on degradation information generated by sensing an entire region of the display panel when the display panel is powered on or off, or perform the degradation compensation for the display panel based on accumulated data of degradation information generated by sensing a partial region of the display panel when the display panel is powered on or off.

However, when utilizing a technique that senses an entire region of the display panel, a viewer may recognize (e.g., observe or perceive) a degradation sensing operation performed on the display panel because the degradation sensing time may be relatively long. In addition, when utilizing a technique that senses a partial region of the display panel, the degradation compensation may be inaccurately performed for the display panel before the degradation information is sufficiently accumulated.

The above information disclosed in this Background section is only to enhance the understanding of the background of the disclosure, and therefore it may contain information that does not constitute prior art.

SUMMARY

Example embodiments of the present invention relate generally to a display device and a method of driving the same. Some example embodiments of the present invention relate to a display device that performs a degradation sensing operation and a method of driving the display device.

According to some example embodiments of the present invention, a method of driving a display device may enable control of the display device to efficiently perform degradation compensation for a display panel.

According to an aspect of example embodiments of the present invention, a display device may include: a display panel comprising a plurality of pixels; a scan driver configured to provide a scan signal to the display panel; a data driver configured to provide a data signal to the display panel; a driving controller configured to control the scan driver and the data driver; a temperature sensor configured to sense local temperatures of local regions of the display panel using at least one temperature sensor located on the display panel and to generate temperature sensing information indicating the local temperatures; a current sensor configured to sense driving currents of the local regions and to generate current sensing information indicating the driving currents; and a sensing controller configured to control the temperature sensor and the current sensor to select sensing target regions based on respective degradation degrees of the local regions, to determine sensing priorities between the sensing target regions, and to control the sensing target regions to be sequentially sensed only during a sensing execution time according to the sensing priorities between the sensing target regions.

According to some embodiments, the display device further includes a degradation compensator configured to perform degradation compensation for the local regions based on the degradation degrees.

According to some embodiments, the sensing controller comprises: a sensing region selection block configured to select the sensing target regions based on accumulated data of the temperature sensing information, accumulated data of the current sensing information, and degradation expectation information according to an image to be displayed on the display panel; a timer block configured to measure respective sensing waiting times corresponding to a time elapsed from a previous time point at which each of the sensing target regions was sensed; a sensing priority determination block configured to determine the sensing priorities between the sensing target regions based on the degradation degrees and the sensing waiting times; and a sensing execution block configured to control the temperature sensor and the current sensor to control the sensing target regions to be sequentially sensed only during the sensing execution time according to the sensing priorities between the sensing target regions.

According to some embodiments, the sensing region selection block is configured to select a first local region having an average local temperature that is higher than a predetermined reference temperature as the sensing target region.

According to some embodiments, the sensing region selection block is configured to select a second local region having an average driving current that is greater than a predetermined reference current as the sensing target region.

According to some embodiments, the sensing region selection block is configured to select a third local region having an image change that is smaller than a predetermined reference change as the sensing target region.

According to some embodiments, the sensing region selection block is configured to change the sensing target regions in real-time.

According to some embodiments, the sensing region selection block is configured to change the sensing target regions at an interval of a predetermined time.

According to some embodiments, the sensing region selection block is configured to change the sensing target regions at an interval of a predetermined number of times a degradation sensing operation is performed.

According to some embodiments, the sensing region selection block is configured to select a fourth local region having the average local temperature that is lower than the predetermined reference temperature, having the average driving current that is smaller than the predetermined reference current, and having the image change that is greater than the predetermined reference change as the sensing target region.

According to some embodiments, the sensing priority of the fourth local region selected as the sensing target region is determined to be lower than the sensing priorities of the first through third local regions selected as the sensing target regions.

According to some embodiments, the timer block is configured to initialize the sensing waiting times of the sensing target regions to be zero when each of the sensing target regions is sensed and to increase the sensing waiting times of the sensing target regions as the display panel operates.

According to some embodiments, the sensing priority determination block is configured to define first through (j)th sensing waiting groups, where j is an integer greater than or equal to 2, and to determine the sensing priority of an (n−1)th sensing waiting group to be higher than the sensing priority of an (n)th sensing waiting group, where n is an integer between 2 and j.

According to some embodiments, the sensing priority determination block is configured to classify the sensing target regions into first through (k)th sensing target groups, where k is an integer greater than or equal to 2, and to determine the sensing priority of an (m−1)th sensing target group to be higher than the sensing priority of an (m)th sensing target group, where m is an integer between 2 and k.

According to some embodiments, the sensing execution block is configured to control the sensing target regions to be sequentially sensed in the order of first through (j)th sensing waiting groups, and the sensing execution block is configured to control the sensing target regions included in the same sensing waiting group to be sequentially sensed in the order of first through (k)th sensing target groups.

According to some embodiments, the sensing execution block is configured to perform a degradation sensing operation on the sensing target regions when the display panel is powered on or off.

According to some example embodiments of the present invention, in a method of driving a display device, the method includes: sensing local temperatures of local regions of a display panel to generate temperature sensing information indicating the local temperatures; sensing driving currents of the local regions to generate current sensing information indicating the driving currents; selecting sensing target regions based on respective degradation degrees of the local regions that are determined based on accumulated data of the temperature sensing information, accumulated data of the current sensing information, and degradation expectation information according to an image to be displayed on the display panel; measuring respective sensing waiting times corresponding to a time elapsed from a previous time point at which each of the sensing target regions was sensed; determining sensing priorities between the sensing target regions based on the degradation degrees and the sensing waiting times; and sequentially sensing the sensing target regions only during a sensing execution time according to the sensing priorities between the sensing target regions.

According to some embodiments, determining the sensing priorities between the sensing target regions comprises: defining first through (j)th sensing waiting groups, where j is an integer greater than or equal to 2; determining the sensing priority of an (n−1)th sensing waiting group to be higher than the sensing priority of an (n)th sensing waiting group, where n is an integer between 2 and j; classifying the sensing target regions into first through (k)th sensing target groups, where k is an integer greater than or equal to 2; and determining the sensing priority of an (m−1)th sensing target group to be higher than the sensing priority of an (m)th sensing target group, where m is an integer between 2 and k.

According to some embodiments, determining the sensing priorities between the sensing target regions further comprises: putting the sensing priorities between the first through (j)th sensing waiting groups before the sensing priorities between the first through (k)th sensing target groups.

According to some embodiments, sensing the sensing target regions comprises: detecting that the display panel is powered on or off; and performing a degradation sensing operation on the sensing target regions when the display panel is powered on or off.

Therefore, a display device according to some example embodiments of the present invention may accurately perform degradation compensation for a display panel and may allow a viewer not to recognize (e.g., observe or perceive) a degradation sensing operation performed on the display panel by selecting sensing target regions based on respective degradation degrees of local regions of the display panel (e.g., accumulated data of temperature sensing information of the local regions of the display panel, accumulated data of current sensing information of the local regions of the display panel, and degradation expectation information according to an image to be displayed on the display panel), by determining sensing priorities between the sensing target regions based on respective degradation degrees and respective sensing waiting times of the local regions of the display panel (e.g., the sensing target regions), and by controlling the sensing target regions to be sequentially sensed only during a sensing execution time according to the sensing priorities between the sensing target regions.

In addition, a method of driving a display device according to some example embodiments may enable control of the display device to efficiently perform degradation compensation for a display panel.

BRIEF DESCRIPTION OF THE DRAWINGS

Illustrative, non-limiting example embodiments of the present invention will be more clearly understood from the following detailed description taken in conjunction with the accompanying drawings.

DETAILED DESCRIPTION

Figure 1:
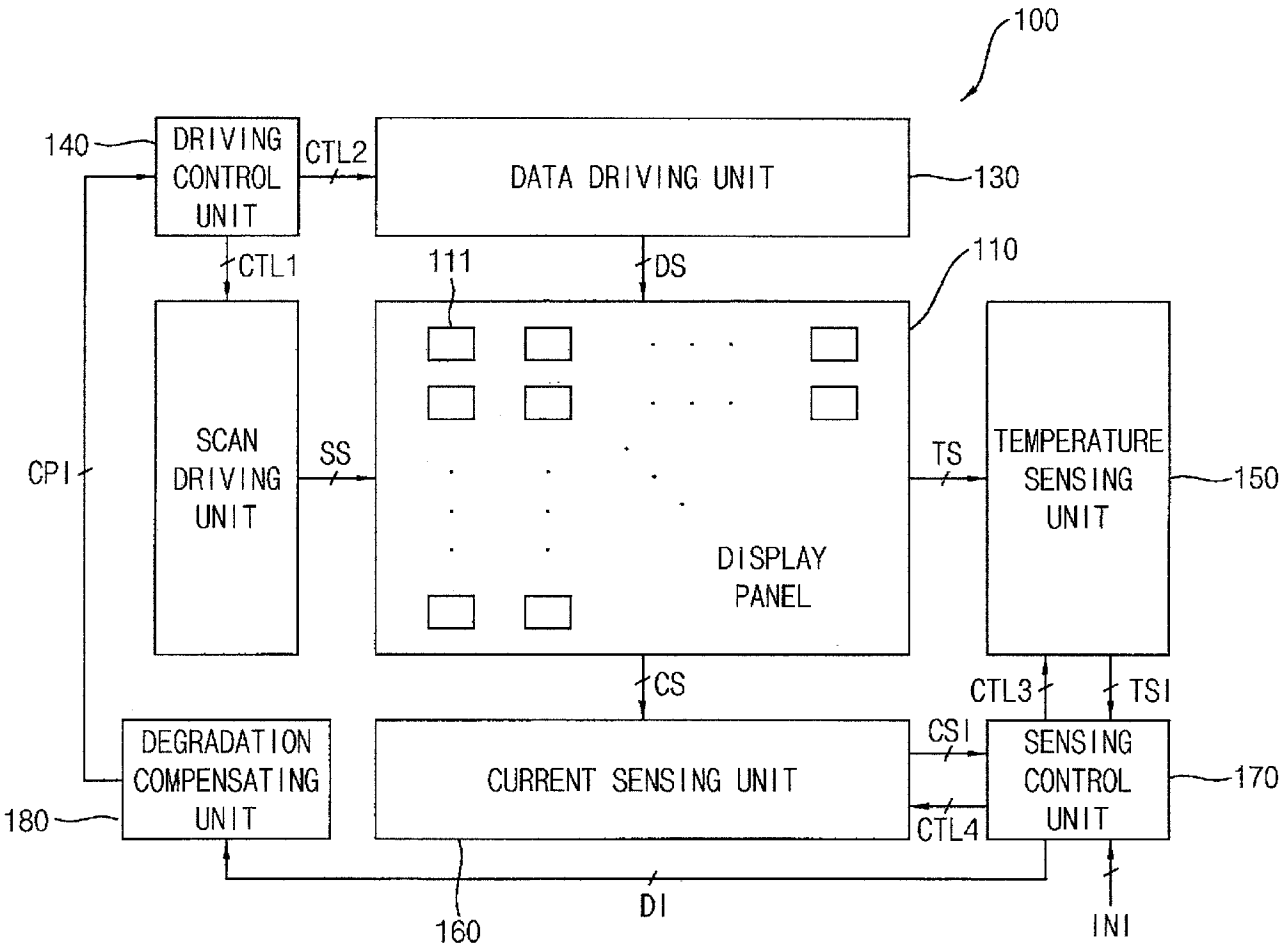
FIG. 1 is a block diagram illustrating a display device, according to some example embodiments of the present invention.

Hereinafter, some example embodiments of the present invention will be explained in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
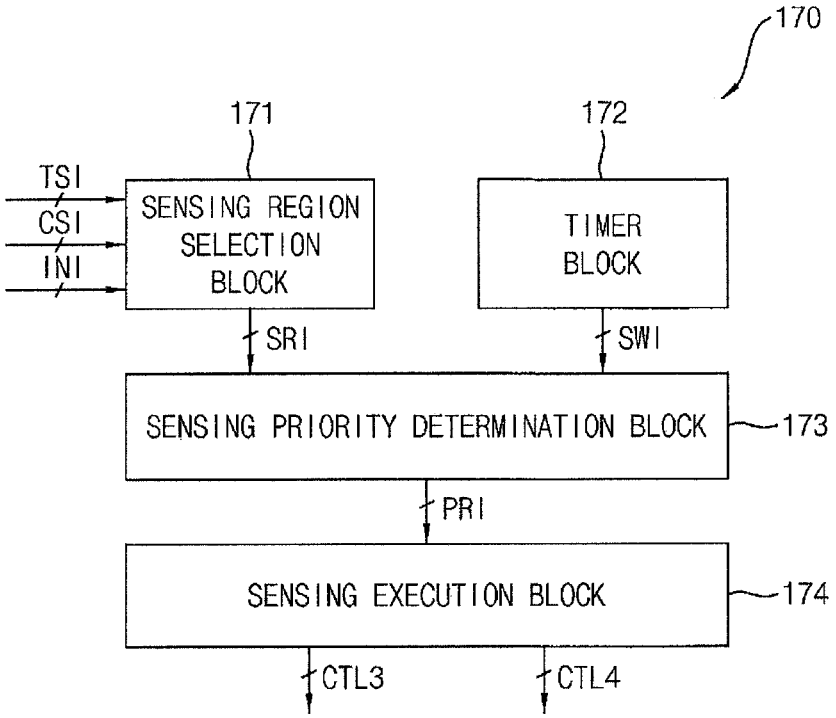
FIG. 2 is a block diagram illustrating an example of a sensing control unit included in the display device of FIG. 1.
Figure 3A:
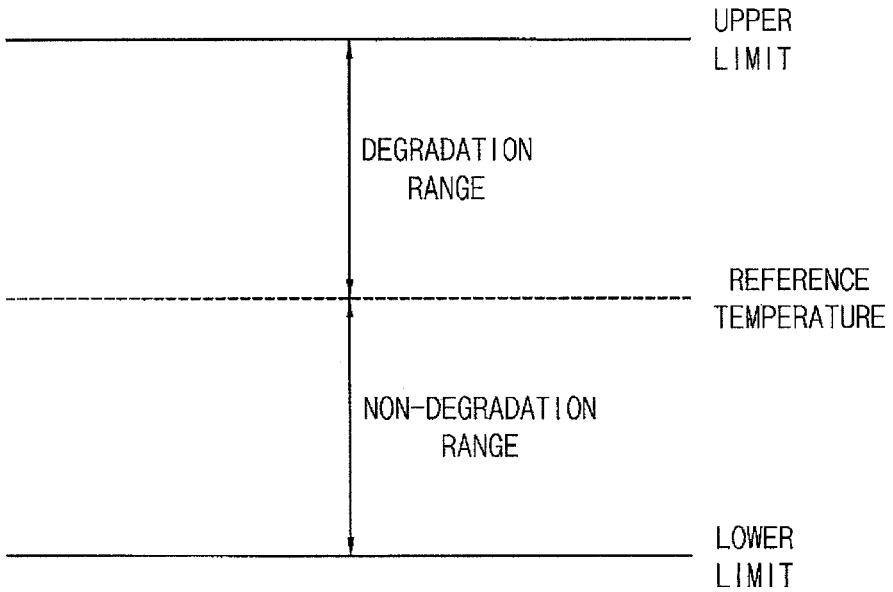
FIG. 3A is a diagram illustrating an example in which a first local region is selected as a sensing target region of a display panel by the display device of FIG. 1.
Figure 3B:
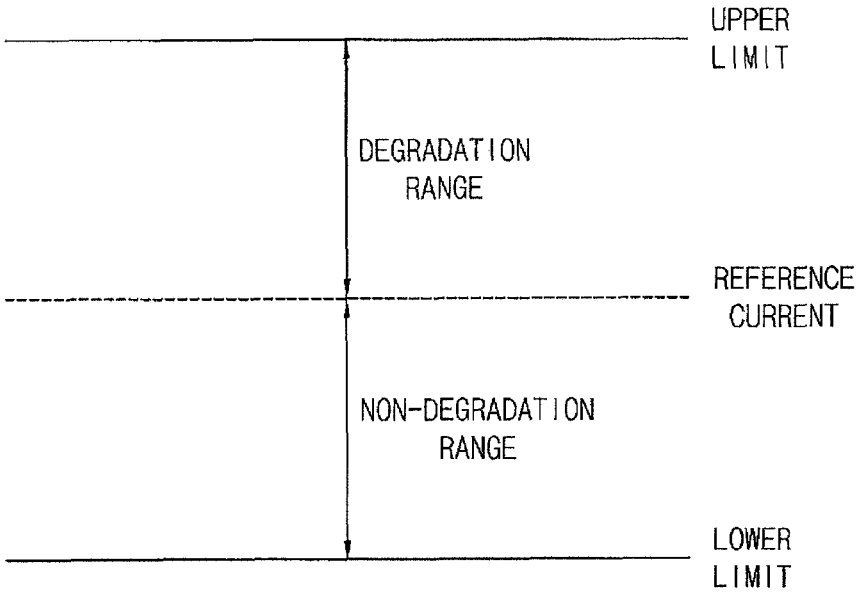
FIG. 3B is a diagram illustrating an example in which a second local region is selected as a sensing target region of a display panel by the display device of FIG. 1.
Figure 3C:
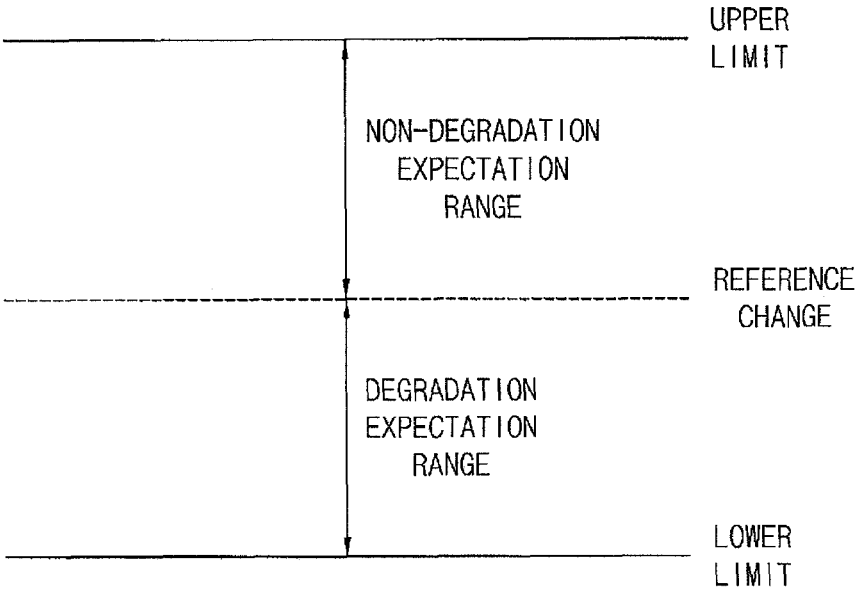
FIG. 3C is a diagram illustrating an example in which a third local region is selected as a sensing target region of a display panel by the display device of FIG. 1.

FIG. 1 is a block diagram illustrating a display device according to some example embodiments of the present invention. FIG. 2 is a block diagram illustrating an example of a sensing control unit included in the display device of FIG. 1. FIG. 3A is a diagram illustrating an example in which a first local region is selected as a sensing target region of a display panel by the display device of FIG. 1. FIG. 3B is a diagram illustrating an example in which a second local region is selected as a sensing target region of a display panel by the display device of FIG. 1. FIG. 3C is a diagram illustrating an example in which a third local region is selected as a sensing target region of a display panel by the display device of FIG. 1.

Referring to FIGS. 1 through 3C, the display device 100 may include a display panel 110, a scan driving unit (or scan driver) 120, a data driving unit (or data driver) 130, a driving control unit (or driving controller) 140, a temperature sensing unit (or temperature sensor) 150, a current sensing unit (or current sensor) 160, and a sensing control unit (or sensing controller) 170. In some example embodiments, the display device 100 may further include a degradation compensating unit (or degradation compensator) 180. Here, the display device 100 may be an organic light emitting display device. However, the display device 100 is not limited thereto. For example, the display device 100 may be a display device that includes a plurality of pixels for which degradation compensation may be provided due to degradation of the pixels as the display device has been used for a long time.

The display panel 110 may include a plurality of pixels. The display panel 110 may be connected to the scan driving unit 120 via a plurality of scan-lines. The display panel 110 may be connected to the data driving unit 130 via a plurality of data-lines. The scan driving unit 120 may provide a scan signal SS to the display panel 110 via the scan-lines. The data driving unit 130 may provide a data signal DS to the display panel 110 via the data-lines.

The driving control unit 140 (e.g., a timing controller, etc.) may generate control signals CTL1 and CTL2 to control the scan driving unit 120 and the data driving unit 130. The driving control unit 140 may receive image data, may generate final image data by performing data processing (e.g., degradation compensation, gamma correction, etc.) on the image data, and may provide the final image data to the data driving unit 130.

Here, the driving control unit 140 may receive compensation information CPI from the degradation compensating unit 180, may generate the final image data (e.g., degradation-compensated image data) by performing the data processing on the image data based on the compensation information CPI, and may provide the final image data to the data driving unit 130.

The temperature sensing unit 150 may sense local temperatures TS of local regions of the display panel 110 using at least one temperature sensor 111 located on the display panel 110 and may generate temperature sensing information TSI indicating the local temperatures TS.

The current sensing unit 160 may sense driving currents CS of the local regions of the display panel 110 and may generate current sensing information CSI indicating the driving currents CS. The sensing control unit 170 may control the temperature sensing unit 150 and the current sensing unit 160 to select sensing target regions based on respective degradation degrees of the local regions of the display panel 110, to determine sensing priorities between the sensing target regions, and to control the sensing target regions to be sequentially sensed only during a sensing execution time according to the sensing priorities.

The degradation compensating unit 180 may perform degradation compensation for the local regions based on respective degradation degrees of the local regions of the display panel 110. For this operation, the degradation compensating unit 180 may receive degradation information DI indicating respective degradation degrees of the local regions from the sensing control unit 170 and may generate the compensation information CPI to be provided to the driving control unit 140 based on the degradation information DI.

As described above, the sensing control unit 170 may control the temperature sensing unit 150 and the current sensing unit 160 to select the sensing target regions based on respective degradation degrees of the local regions of the display panel 110, to determine the sensing priorities between the sensing target regions, and to control the sensing target regions to be sequentially sensed only during the sensing execution time according to the sensing priorities. For this operation, as illustrated in FIG. 2, the sensing control unit 170 may include a sensing region selection block 171, a timer block 172, a sensing priority determination block 173, and a sensing execution block 174.

The sensing region selection block 171 may receive the temperature sensing information TSI indicating the local temperatures of the local regions of the display panel 110 from the temperature sensing unit 150, may receive the current sensing information CSI indicating the driving currents of the local regions of the display panel 110 from the current sensing unit 160, and may select the sensing target regions based on accumulated data of the temperature sensing information TSI, accumulated data of the current sensing information CSI, and degradation expectation information INI according to an image to be displayed on the display panel 110.

That is, the sensing region selection block 171 may provide sensing target region information SRI relating to the sensing target regions of the display panel 110 to the sensing priority determination block 173. For example, the sensing target regions may be selected based on the temperature sensing information TSI because of a relatively high possibility of degradation of a local region where a temperature is relatively high when the display panel 110 is powered off.

In addition, the sensing target regions may be selected based on the current sensing information CSI because of a relatively high driving current at a local region at which a degradation degree is relatively high. Further, the sensing target regions may be selected based on the degradation expectation information INI because of a relatively high possibility of degradation at a local region at which an image change is relatively small or infrequent (e.g., a logo region, a subtitle region, a task bar region, etc).

Here, because some of all local regions of the display panel 110 can be sensed when the display panel 110 is powered on or off, the sensing region selection block 171 may use the accumulated data of the temperature sensing information TSI and the current sensing information CSI when selecting the sensing target regions. In an example embodiment, the sensing region selection block 171 may change the sensing target regions of the display panel 110 in real-time. In another example embodiment, the sensing region selection block 171 may change the sensing target regions of the display panel 110 at a time interval (e.g., a predetermined time interval). In still another example embodiment, the sensing region selection block 171 may change the sensing target regions of the display panel 110 at an interval of a number (e.g., a predetermined number) of times that the degradation sensing operation is performed.

As illustrated in FIG. 3A, the sensing region selection block 171 may select a first local region having an average local temperature that is higher than a reference temperature (e.g., a predetermined reference temperature) REFERENCE TEMPERATURE as the sensing target region when selecting the sensing target regions of the display panel 110 based on the temperature sensing information TSI. That is, the sensing region selection block 171 may select the first local region having the average local temperature within a degradation range DEGRADATION RANGE as the sensing target region based on the temperature sensing information TSI.

In addition, as illustrated in FIG. 3B, the sensing region selection block 171 may select a second local region having an average driving current that is greater than a reference current (e.g., a predetermined reference current) REFERENCE CURRENT as the sensing target region when selecting the sensing target regions of the display panel 110 based on the current sensing information CSI.

That is, the sensing region selection block 171 may select the second local region having the average driving current within a degradation range DEGRADATION RANGE as the sensing target region based on the current sensing information CSI. Further, as illustrated in FIG. 3C, the sensing region selection block 171 may select a third local region having an image change that is smaller than a reference change (e.g. a predetermined reference change) REFERENCE CHANGE as the sensing target region when selecting the sensing target regions of the display panel 110 based on the degradation expectation information INI.

That is, the sensing region selection block 171 may select the third local region having the image change within a degradation expectation range DEGRADATION EXPECTATION RANGE as the sensing target region based on the degradation expectation information INI. For example, the sensing region selection block 171 may select a local region having a relatively high degradation degree as the sensing target region of the display panel 110.

In some example embodiments, because performing the degradation sensing operation on a local region having a relatively low degradation degree may be required under a certain condition, the sensing region selection block 171 may select a fourth local region having the average local temperature that is lower than the reference temperature (e.g., the predetermined reference temperature) REFERENCE TEMPERATURE, having the average driving current that is smaller than the reference current (e.g., the predetermined reference current) REFERENCE CURRENT, and having the image change that is greater than the reference change (e.g., the predetermined reference change) REFERENCE CHANGE as the sensing target region. In this case, because a sensing priority of the fourth local region is determined to be lower than respective sensing priorities of the first through third local regions, the degradation sensing operation may not be frequently performed on the fourth local region having the relatively low degradation degree. In this regard, determining the sensing priorities will be described in more detail with reference to FIGS. 4 through 9.

The timer block 172 may measure respective sensing waiting times corresponding to a time elapsed from a previous time point at which each of the sensing target regions of the display panel 110 was sensed. That is, the timer block 172 may provide the sensing priority determination block 173 with sensing waiting time information SWI relating to respective sensing waiting times of the sensing target regions of the display panel 110.

For example, the timer block 172 may initialize a sensing waiting time of a sensing target region to be zero when the sensing target region is sensed and may increase the sensing waiting time of the sensing target region as the display panel 110 operates. For example, because a sensing waiting time of a sensing target region indicates how long the sensing target region waits, the sensing waiting time of the sensing target region may be initialized to be zero when the sensing target region is sensed.

Then, the sensing waiting time of the sensing target region may increase as the display panel 110 operates. For this reason, a sensing target region having a relatively long sensing waiting time may have a sensing priority higher than a sensing priority of a sensing target region having a relatively short sensing waiting time. The sensing priority determination block 173 may determine sensing priorities between the sensing target regions based on the degradation degrees and the sensing waiting times of the local regions of the display panel 110 (e.g., the sensing target regions). That is, the sensing priority determination block 173 may receive sensing target region information SRI relating to the sensing target regions of the display panel 110 from the sensing region selection block 171, may receive sensing waiting time information SWI relating to the sensing waiting times of the sensing target regions of the display panel 110 from the timer block 172, may generate sensing priority information PRI relating to the sensing priorities between the sensing target regions of the display panel 110 based on the sensing target region information SRI and the sensing waiting time information SWI to provide the sensing priority information PRI to the sensing execution block 174.

Here, when the sensing priority determination block 173 determines the sensing priorities between the sensing target regions of the display panel 110, the sensing priority determination block 173 may define first through (j)th sensing waiting groups, where j is an integer greater than or equal to 2, and may determine a sensing priority of an (n−1)th sensing waiting group to be higher than a sensing priority of an (n)th sensing waiting group, where n is an integer between 2 and j. That is, the sensing priority determination block 173 may determine, based on the sensing waiting time information SWI, which of the first through (j)th sensing waiting groups a sensing target region belongs to.

In addition, when the sensing priority determination block 173 determines the sensing priorities between the sensing target regions of the display panel 110, the sensing priority determination block 173 may classify the sensing target regions into first through (k)th sensing target groups, where k is an integer greater than or equal to 2, and may determine a sensing priority of an (m−1)th sensing target group to be higher than a sensing priority of an (m)th sensing target group, where m is an integer between 2 and k.

That is, the sensing priority determination block 173 may determine, based on the sensing target region information SRI, which of the first through (k)th sensing target groups a sensing target region belongs to.

The sensing execution block 174 may control the temperature sensing unit 150 and the current sensing unit 160. The sensing execution block 174 may control the sensing target regions of the display panel 110 to be sequentially sensed only during a sensing execution time according to the sensing priorities determined by the sensing priority determination block 173.

The sensing execution block 174 may receive the sensing priority information PRI relating to the sensing priorities between the sensing target regions of the display panel 110 from the sensing priority determination block 173 and may generate, based on the sensing priority information PRI, control signals CTL3 and CTL4 for controlling the temperature sensing unit 150 and the current sensing unit 160 based on the sensing priority information PRI. According to some example embodiments of the present invention, the sensing execution block 174 may perform a degradation sensing operation on the sensing target regions of the display panel 110 when the display panel 110 is powered on or off.

In addition, the sensing execution time during which the degradation sensing operation is sequentially performed on the sensing target regions of the display panel 110 may be set for a viewer not to recognize the degradation sensing operation performed on the display panel 110. In an example embodiment, the sensing execution block 174 may control the sensing target regions to be sequentially sensed in the order of first through (j)th sensing waiting groups. Here, the sensing execution block 174 may control the sensing target regions included in the same sensing waiting group to be sequentially sensed in the order of first through (k)th sensing target groups. In other words, the sensing priorities between the first through (j)th sensing waiting groups may have precedence (or priority) over the sensing priorities between the first through (k)th sensing target groups.

As described above, the display device 100 may accurately perform degradation compensation for the display panel 100 and may allow a viewer not to recognize (e.g., observe or perceive) the degradation sensing operation performed on the display panel 110 by selecting the sensing target regions based on respective degradation degrees of the local regions of the display panel 100 (e.g., the accumulated data of the temperature sensing information TSI of the local regions of the display panel 110, the accumulated data of the current sensing information CSI of the local regions of the display panel 100, and the degradation expectation information INI according to an image to be displayed on the display panel 110), by determining the sensing priorities between the sensing target regions based on respective degradation degrees and respective sensing waiting times of the local regions of the display panel 110 (e.g., the sensing target regions), and by controlling the sensing target regions to be sequentially sensed only during the sensing execution time according to the sensing priorities between the sensing target regions.

Figure 4:
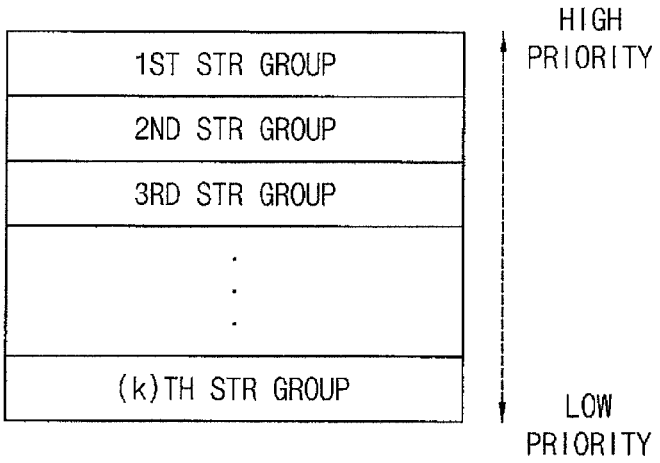
FIG. 4 is a diagram illustrating an example in which sensing priorities between sensing target groups are determined by the display device of FIG. 1.
Figure 5:
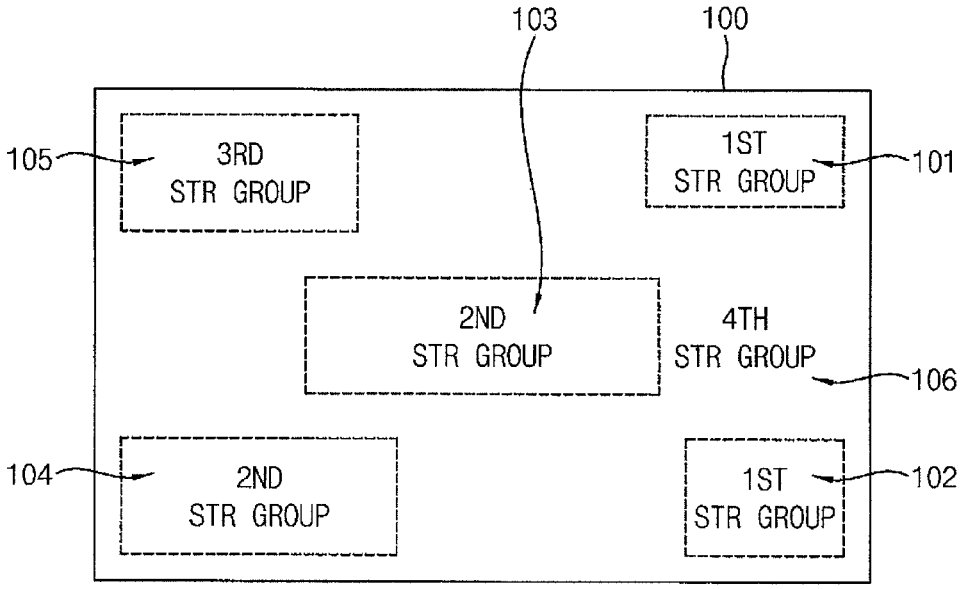
FIG. 5 is a diagram for describing an example in which sensing priorities between sensing target groups are determined by the display device of FIG. 1.
Figure 6:
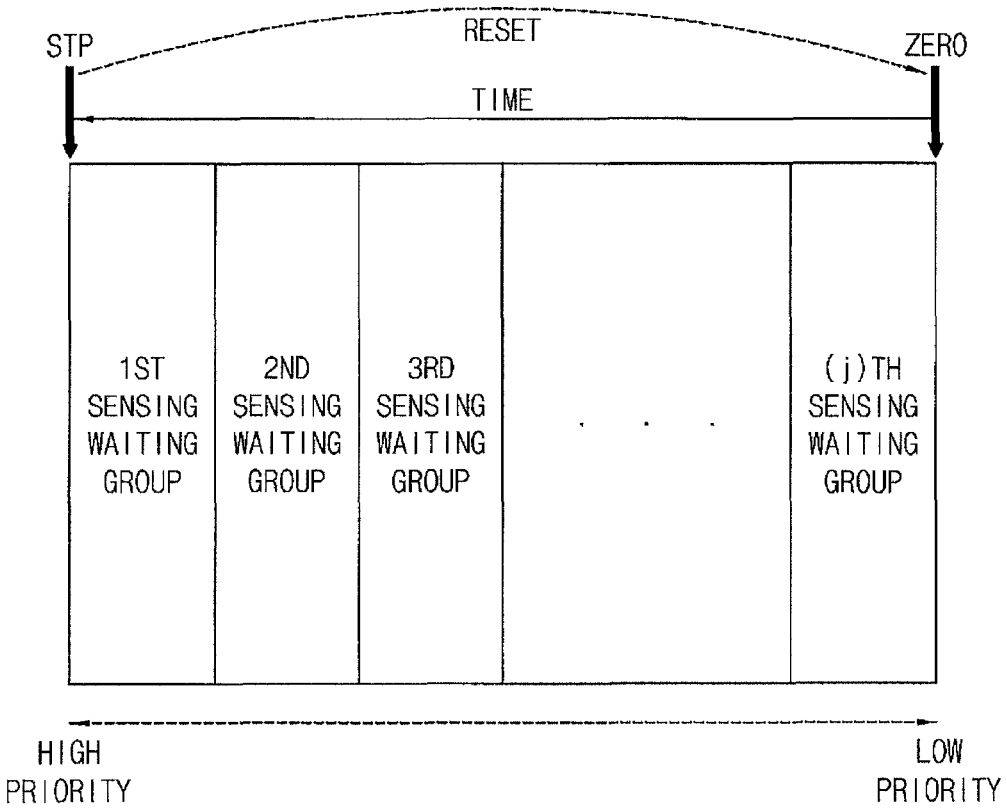
FIG. 6 is a diagram illustrating an example in which sensing priorities between sensing waiting groups are determined by the display device of FIG. 1.

FIG. 4 is a diagram illustrating an example in which sensing priorities between sensing target groups are determined by the display device of FIG. 1. FIG. 5 is a diagram for describing an example in which sensing priorities between sensing target groups are determined by the display device of FIG. 1. FIG. 6 is a diagram illustrating an example in which sensing priorities between sensing waiting groups are determined by the display device of FIG. 1.

Referring to FIGS. 4 through 6, it is illustrated in FIGS. 4 and 5 that the display device 100 determines the sensing priorities between the first through (k)th sensing target groups 1ST STR GROUP through (k)TH STR GROUP. In addition, it is illustrated in FIG. 6 that the display device 100 determines the sensing priorities between the first through (j)th sensing waiting groups 1ST SENSING WAITING GROUP through (j)TH SENSING WAITING GROUP. Here, the display device 100 may determine the sensing priorities between the sensing target regions based on respective degradation degrees and respective sensing waiting times of the sensing target regions of the display panel 110.

For example, the display device 100 may classify the sensing target regions into the first through (k)th sensing target groups 1ST STR GROUP through (k)TH STR GROUP based on respective degradation degrees of the sensing target regions of the display panel 110 and may determine the sensing priority of the (m−1)th sensing target group to be higher than the sensing priority of the (m)th sensing target group. That is, when a specific sensing target region of the display panel 110 is classified into the first sensing target group 1ST STR GROUP, a sensing priority of the specific sensing target region may be relatively high (e.g., indicated by HIGH PRIORITY). On the other hand, when a specific sensing target region of the display panel 110 is classified into the (k)th sensing target group (k)TH STR GROUP, a sensing priority of the specific sensing target region may be relatively low (e.g., indicated by LOW PRIORITY).

For example, a sensing target region corresponding to a local region having the average local temperature that is higher than the reference temperature (e.g., the predetermined reference temperature), having the average driving current that is greater than the reference current (e.g., the predetermined reference current), and having the image change that is smaller than the predetermined reference change may be classified into the first sensing target group 1ST STR GROUP.

On the other hand, a sensing target region corresponding to a local region having the average local temperature that is lower than the reference temperature (e.g., the predetermined reference temperature), having the average driving current that is smaller than the reference current (e.g., the predetermined reference current), and having the image change that is greater than the reference change (e.g., the predetermined reference change) may be classified into the (k)th sensing target group (k)TH STR GROUP.

However, a way of classifying the sensing target regions into the first through (k)th sensing target groups 1ST STR GROUP through (k)TH STR GROUP is not limited thereto. For example, a way of giving priority to specific criterion (e.g., the average local temperature, the average driving current, the image change, etc.) may be employed according to requirements of the display device 100. As illustrated in FIG. 5, when the sensing target regions of the display panel 110 are classified into the first through (k)th sensing target groups 1ST STR GROUP through (k)TH STR GROUP, one sensing target group may include one region (e.g., 105 in FIG. 5) or may include several regions (e.g., 101-102 and 103-104 in FIG. 5). In some example embodiments, when one sensing target group includes a region of which an area is relatively large (e.g., 106 in FIG. 5), the sensing target group may include a plurality of sub-sensing target groups having different sensing priorities.

In addition, the display device 100 may classify the sensing target regions into the first through (j)th sensing waiting groups 1ST SENSING WAITING GROUP through (j)TH SENSING WAITING GROUP based on respective sensing waiting times of the sensing target regions of the display panel 110 and may determine the sensing priority of the (n−1)th sensing target group to be higher than the sensing priority of the (n)th sensing target group. That is, when a specific sensing target region of the display panel 110 is classified into the first sensing waiting group 1ST SENSING WAITING GROUP, a sensing priority of the specific sensing target region may be relatively high (e.g., indicated by HIGH PRIORITY). On the other hand, when a specific sensing target region of the display panel 110 is classified into the (j)th sensing waiting group (j)TH SENSING WAITING GROUP, a sensing priority of the specific sensing target region may be relatively low (e.g., indicated by LOW PRIORITY).

Here, the sensing waiting time of the specific sensing target region may increase (e.g., the specific sensing target region may be sequentially moved from the (j)th sensing waiting group (j)TH SENSING WAITING GROUP to the first sensing waiting group 1ST SENSING WAITING GROUP) as the display panel 110 operates (e.g., indicated by TIME). On the other hand, when the specific sensing target region is sensed (e.g., indicated by STP), the sensing waiting time of the specific sensing target region may be initialized to be zero (e.g., indicated as RESET).

Thus, a specific sensing target region belonging to the first sensing waiting group 1ST SENSING WAITING GROUP (e.g., having a relatively high sensing priority) may be moved to the (j)th sensing waiting group (j)TH SENSING WAITING GROUP (e.g., having a relatively low sensing priority) as the specific sensing target region is sensed.

According to some example embodiments of the present invention, the display device 100 may put the sensing priorities between the first through (j)th sensing waiting groups 1ST SENSING WAITING GROUP through (j)TH SENSING WAITING GROUP before the sensing priorities between the first through (k)th sensing target groups 1ST STR GROUP through (k)TH STR GROUP. In this case, the sensing target regions of the display panel 110 may be sequentially sensed in the order of the first through (j)th sensing waiting groups 1ST SENSING WAITING GROUP through (j)TH SENSING WAITING GROUP, and the sensing target regions included in the same sensing waiting group may be sequentially sensed in the order of the first through (k)th sensing target groups 1ST STR GROUP through (k)TH STR GROUP.

Figure 7:
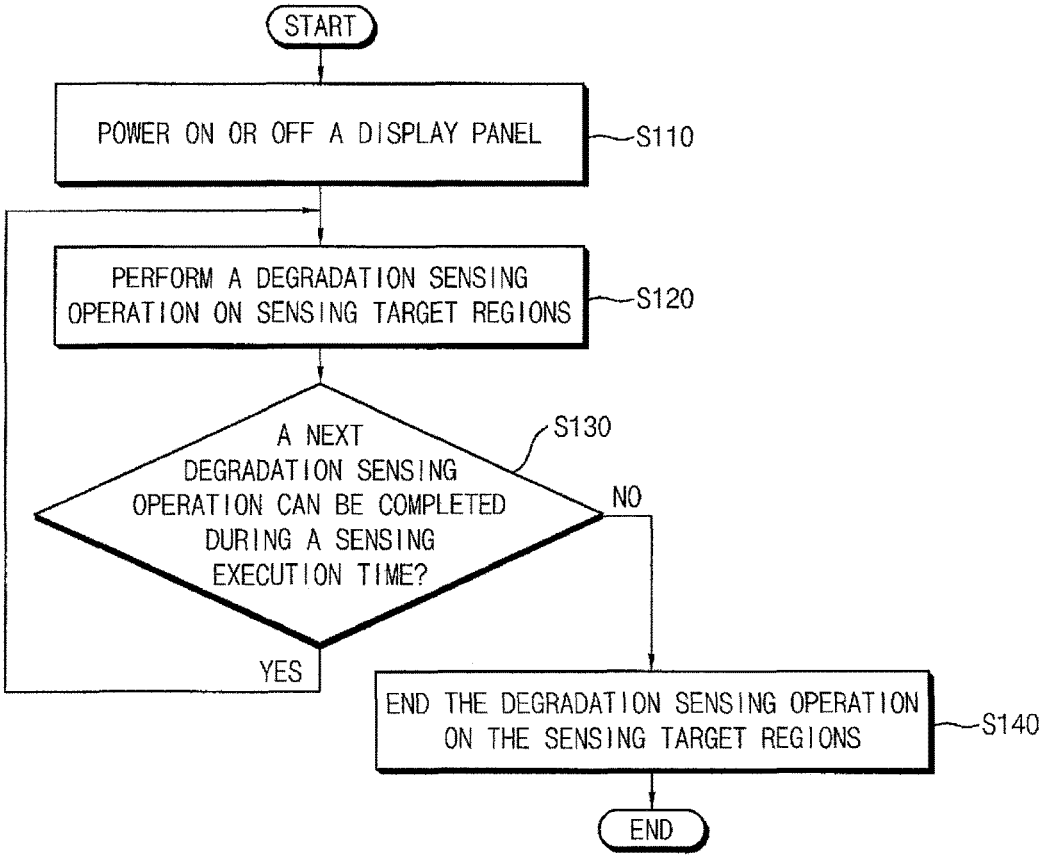
FIG. 7 is a flowchart illustrating an example in which sensing target regions of a display panel are sensed by the display device of FIG. 1.
Figure 8:
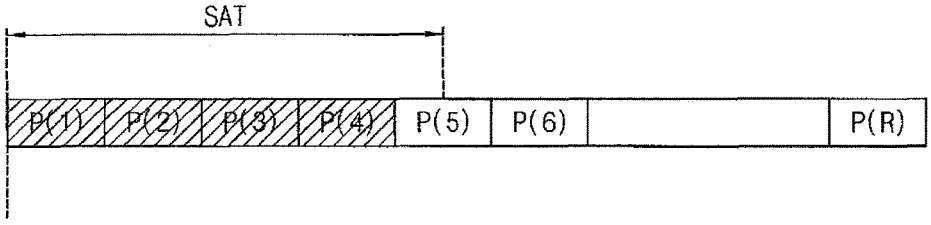
FIG. 8 is a diagram for describing an example in which sensing target regions of a display panel are sensed by the display device of FIG. 1.
Figure 9A:
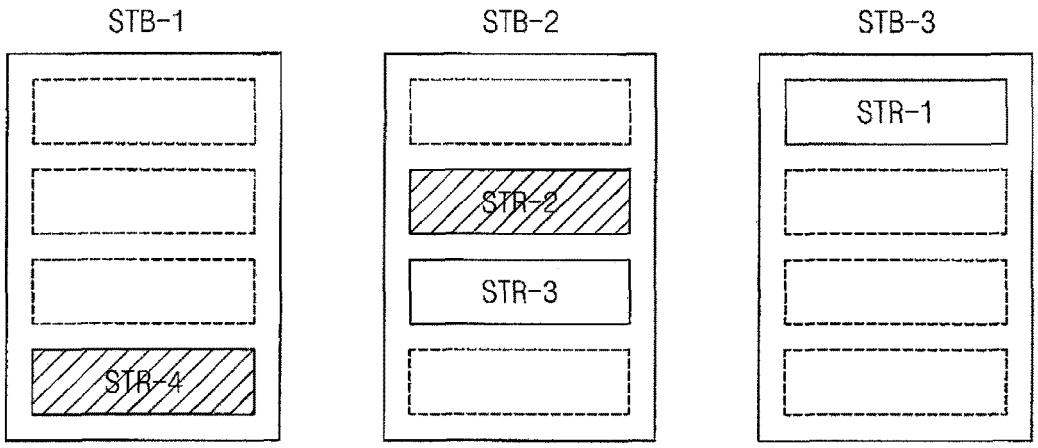
FIGS. 9A through 9C are diagrams illustrating an example in which sensing priorities between sensing target regions of a display panel are changed as a degradation sensing operation is performed by the display device of FIG. 1.
Figure 9B:
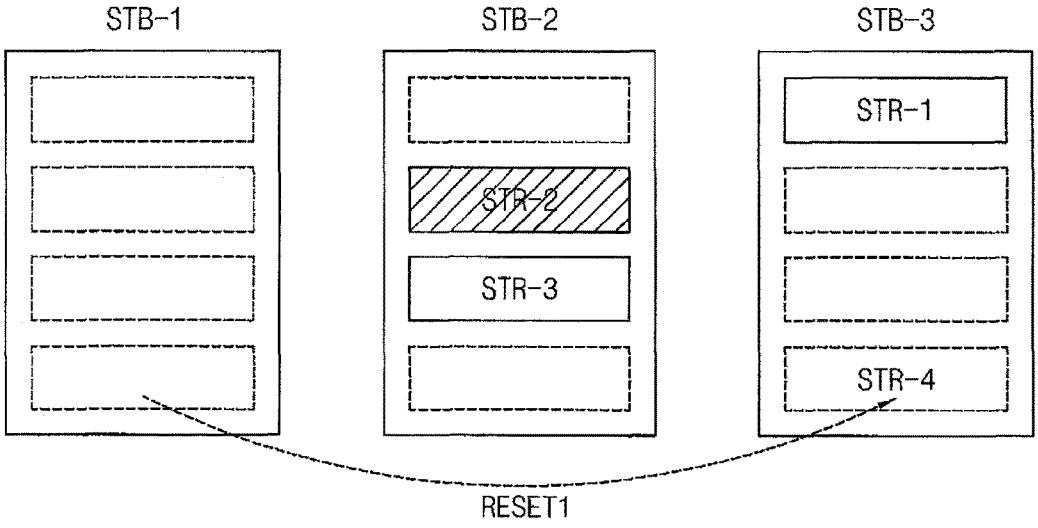
Figure 9C:
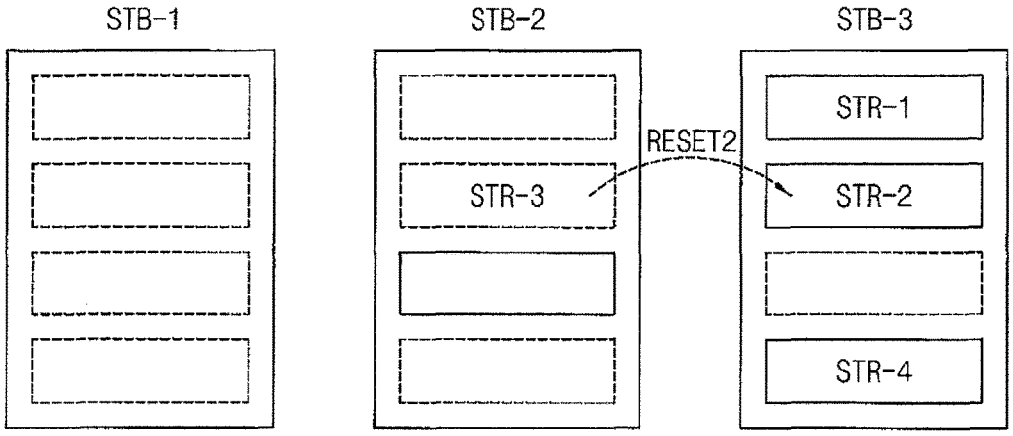

FIG. 7 is a flowchart illustrating an example in which sensing target regions of a display panel are sensed by the display device of FIG. 1. FIG. 8 is a diagram for describing an example in which sensing target regions of a display panel are sensed by the display device of FIG. 1. FIGS. 9A through 9C are diagrams illustrating an example in which sensing priorities between sensing target regions of a display panel are changed as a degradation sensing operation is performed by the display device of FIG. 1.

Referring to FIGS. 7 through 9C, when a display panel 110 is powered on or off (S110), a display device 100 may perform a degradation sensing operation on a sensing target region of the display panel 110 (S120) and then may check whether a next degradation sensing operation (e.g., a degradation sensing operation to be performed on a next sensing target region) can be completed during a sensing execution time (S130).

Here, when the next degradation sensing operation can be completed during the sensing execution time, the display device 100 may repeat the above operations S120 and S130. On the other hand, when the next degradation sensing operation cannot be completed during the sensing execution time, the display device 100 may end the degradation sensing operation on the sensing target region of the display panel 110 (S140).

As illustrated in FIG. 8, assuming that first through (r)th sensing target regions P(1) through P(R) having sequential sensing priorities exist and the sensing execution time SAT is set for a viewer not to recognize the degradation sensing operation on the display panel 110, the display device 100 may sequentially perform the degradation sensing operation on the first through fourth sensing target regions P(1) through P(4) that can be completed during the sensing execution time SAT when the display panel 110 is powered on or off. Subsequently, when the display panel 110 is powered on or off again, the display device 100 may perform the degradation sensing operation on the fifth sensing target region P(5).

In FIGS. 9A through 9C, it is assumed that first through fourth sensing target groups STR-1 through STR-4 having sequential sensing priorities and first through third sensing waiting groups STB-1 through STB-3 having sequential sensing priorities exist. As illustrated in FIG. 9A, because the sensing priorities between the first through third sensing waiting groups STB-1 through STB-3 have precedence over the sensing priorities between the first through fourth sensing target groups STR-1 through STR-4 (e.g., the sensing target regions are sequentially sensed in the order of the first through third sensing waiting groups STB-1 through STB-3 and the sensing target regions included in the same sensing waiting group are sequentially sensed in the order of the first through fourth sensing target groups STR-1 through STR-4), the sensing priorities may be determined in the order of the fourth sensing target group STR-4, the second sensing target group STR-2, the third sensing target group STR-3, and the first sensing target group STR-1.

In other words, as illustrated in FIG. 9A, the fourth sensing target group STR-4 belonging to the first sensing waiting group STB-1 may have the highest sensing priority. Thus, in FIG. 9A, the degradation sensing operation may be performed on the fourth sensing target group STR-4 having the highest sensing priority. Subsequently, after the fourth sensing target group STR-4 is sensed, as illustrated in FIG. 9B, the fourth sensing target group STR-4 may be moved to the third sensing waiting group STB-3 (i.e., indicated by RESET1). As a result, in FIG. 9B, the sensing priorities may be determined in the order of the second sensing target group STR-2, the third sensing target group STR-3, the first sensing target group STR-1, and the fourth sensing target group STR-4.

In other words, as illustrated in FIG. 9B, the fourth sensing target group STR-4 belonging to the third sensing waiting group STB-3 may have the lowest sensing priority, and the second sensing target group STR-2 belonging to the second sensing waiting group STB-2 may have the highest sensing priority. Thus, as illustrated in FIG. 9B, the degradation sensing operation may be performed on the second sensing target group STR-2 having the highest sensing priority. Next, after the second sensing target group STR-2 is sensed, as illustrated in FIG. 9C, the second sensing target group STR-2 may be moved to the third sensing waiting group STB-3 (e.g., indicated by RESET2).

As a result, as illustrated in FIG. 9C, the sensing priorities may be determined in the order of the third sensing target group STR-3, the first sensing target group STR-1, the second sensing target group STR-2, and the fourth sensing target group STR-4. Here, if the fourth sensing target group STR-4 is moved to the second sensing waiting group STB-2 before the second sensing target group STR-2 is moved to the second sensing waiting group STB-2, the sensing priority of the fourth sensing target group STR-4 may be higher than the sensing priority of the second sensing target group STR-2.

As illustrated in FIG. 9C, the degradation sensing operation may be performed on the third sensing target group STR-3 having the highest priority. However, according to some embodiments of the present invention, the degradation sensing operation may not be performed on the third sensing target group STR-3 because the degradation sensing operation can be completed only on the fourth sensing target group STR-4 and the second sensing target group STR-2 during the sensing execution time SAT.

In this way, when the display device 100 performs the degradation sensing operation on the display panel 110, the display device 100 may sense the sensing target regions having relatively high degradation possibility (or, relatively low degradation degree) more often than the sensing target regions having relatively low degradation possibility (or, relatively high degradation degree). In addition, because the display device 100 sequentially senses the sensing target regions only during the sensing execution time SAT according to the sensing priorities between the sensing target regions, the display device 100 may have characteristics of high degradation compensation efficiency, fast operating speed, low power consumption, and the like compared to conventional display devices.

Further, the display device 100 may prevent or reduce instances of a specific pattern being repeatedly sensed because the display device 100 determines the sensing priorities between the sensing target regions based on both respective degradation degrees and respective sensing waiting times of the sensing target regions.

Figure 10:
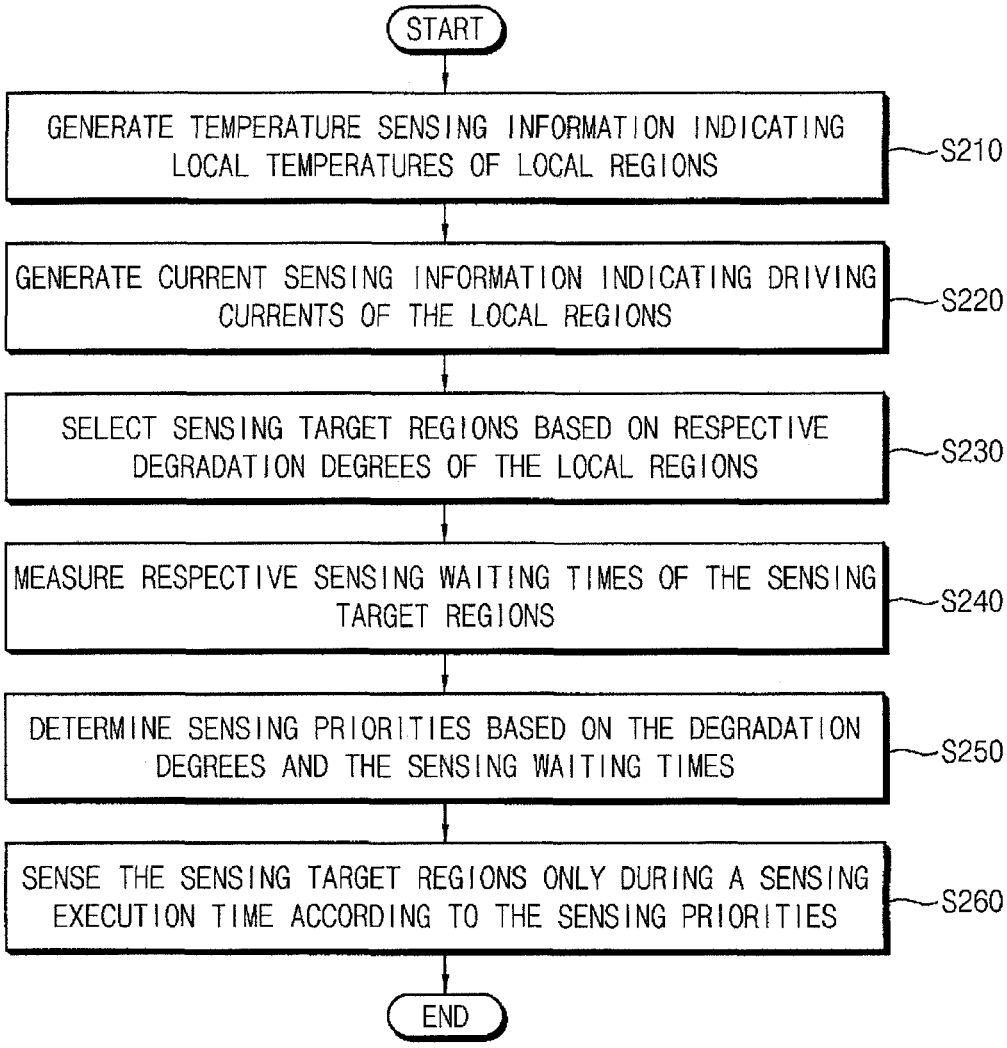
FIG. 10 is a flowchart illustrating a method of driving a display device according to example embodiments.
Figure 11:
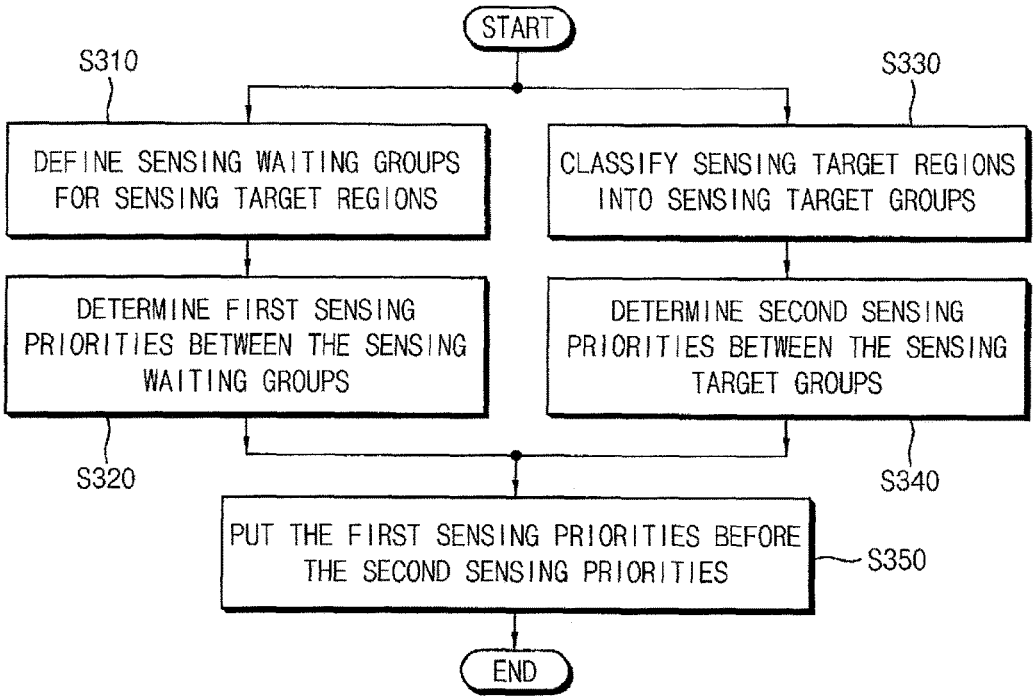
FIG. 11 is a flowchart illustrating an example in which sensing priorities between sensing target regions of a display panel are determined by the method of FIG. 10.
Figure 12:
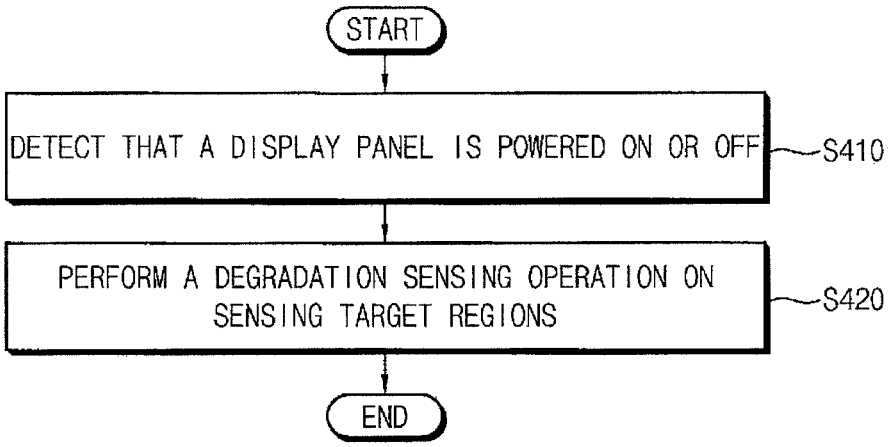
FIG. 12 is a flowchart illustrating an example in which sensing target regions of a display panel are sensed by the method of FIG. 10.

FIG. 10 is a flowchart illustrating a method of driving a display device according to some example embodiments of the present invention. FIG. 11 is a flowchart illustrating an example in which sensing priorities between sensing target regions of a display panel are determined by the method of FIG. 10. FIG. 12 is a flowchart illustrating an example in which sensing target regions of a display panel are sensed by the method of FIG. 10.

Referring to FIGS. 10 through 12, according to the method of FIG. 10, the display device (e.g., the display device 100) may sense local temperatures of local regions of a display panel to generate temperature sensing information indicating the local temperatures of the local regions (S210), may sense driving currents of the local regions to generate current sensing information indicating the driving currents of the local regions (S220), may select sensing target regions based on respective degradation degrees of the local regions that are determined based on accumulated data of the temperature sensing information, accumulated data of the current sensing information, and degradation expectation information according to an image to be displayed on the display panel (S230), may measure respective sensing waiting times corresponding to a time elapsed from a previous time point at which each of the sensing target regions was sensed (S240), may determine sensing priorities between the sensing target regions based on respective degradation degrees and respective sensing waiting times of the local regions (e.g., the sensing target regions) (S250), and may sequentially sense the sensing target regions only during a sensing execution time according to the sensing priorities between the sensing target regions (S260).

Here, when display device (e.g., the display device 100) according to the method of FIG. 10 determines the sensing priorities between the sensing target regions based on respective degradation degrees and respective sensing waiting times of the sensing target regions, the display device may define first through (j)th sensing waiting groups (S310) and may determine a sensing priority of an (n−1)th sensing waiting group to be higher than a sensing priority of an (n)th sensing waiting group (S320).

In addition, the display device (e.g., the display device 100) according to the method of FIG. 10 may classify the sensing target regions into first through (k)th sensing target groups (S330) and may determine a sensing priority of an (m−1)th sensing target group to be higher than a sensing priority of an (m)th sensing target group (S340). Subsequently, the display device (e.g., the display device 100) according to the method of FIG. 10 may put the sensing priorities between the first through (j)th sensing waiting groups before the sensing priorities between the first through (k)th sensing target groups (S350). In other words, according to the method of FIG. 10, the display device (e.g., the display device 100) may sequentially sense the sensing target regions in the order of the first through (n)th sensing waiting groups having sequential sensing priorities and may sequentially sense the sensing target regions included in the same sensing waiting group in the order of the first through (k)th sensing target groups having sequential sensing priorities.

In example embodiments, the display device according to the method of FIG. 10 may perform the degradation sensing operation on the sensing target regions when the display panel is powered on or off. For example, the display device according to the method of FIG. 10 may detect that the display panel is powered on or off (S410) and then may perform the degradation sensing operation on the sensing target regions (S420) when the display panel is powered on or off.

As described above, according to the method of FIG. 10, the display device (e.g., the display device 100) may select the sensing target regions based on respective degradation degrees of the local regions of the display panel (e.g., the accumulated data of the temperature sensing information of the local regions of the display panel, the accumulated data of the current sensing information of the local regions of the display panel, and the degradation expectation information according to an image to be displayed on the display panel), may determine the sensing priorities between the sensing target regions based on respective degradation degrees and respective sensing waiting times of the local regions of the display panel (i.e., the sensing target regions), and may control the sensing target regions to be sequentially sensed only during the sensing execution time according to the sensing priorities between the sensing target regions.

Thus, according to the method of FIG. 10, the display device (e.g., the display device 100) may accurately perform the degradation compensation for the display panel while allowing a viewer not to recognize the degradation sensing operation performed on the display panel. That is, according to the method of FIG. 10, the display device may efficiently perform the degradation compensation for the display panel. Although it is described above that the display device operating according to the method of FIG. 10 generates the temperature sensing information indicating the local temperatures of the local regions by sensing the local temperatures of the local regions of the display panel, in some example embodiments, the method of FIG. 10 may generate the temperature sensing information by extracting necessary portions among the sensed local temperatures (e.g., the temperature sensing information indicating only the highest local temperature among the sensed local temperatures).

Similarly, although it is described above that the display device operating according to the method of FIG. 10 generates the current sensing information indicating the driving currents of the local regions by sensing the driving currents of the local regions of the display panel, in some example embodiments, the method of FIG. 10 may generate the current sensing information by extracting necessary portions among the sensed driving currents (e.g., the current sensing information indicating only the greatest driving current among the sensed driving currents).

Figure 13:
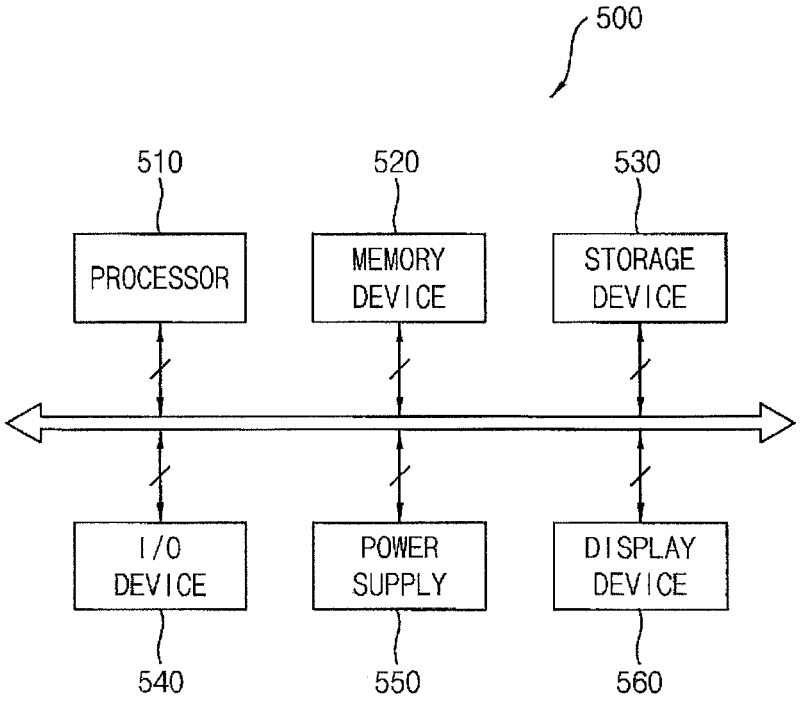
FIG. 13 is a block diagram illustrating an electronic device according to example embodiments.
Figure 14:
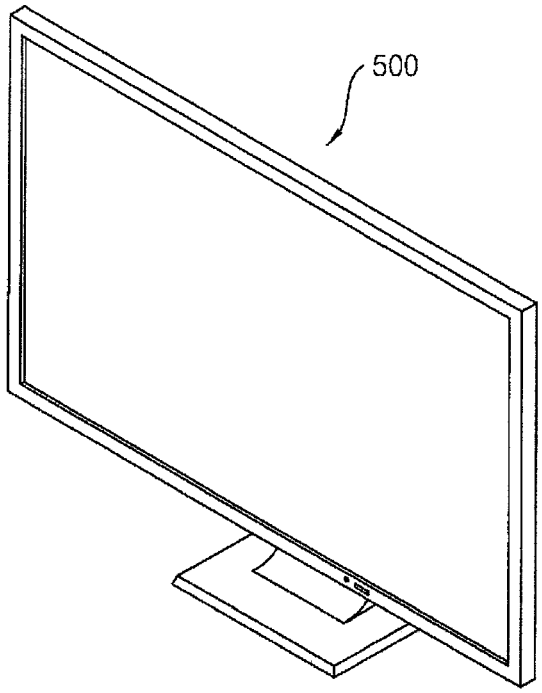
FIG. 14 is a diagram illustrating an example in which the electronic device of FIG. 13 is implemented as a television.
Figure 15:
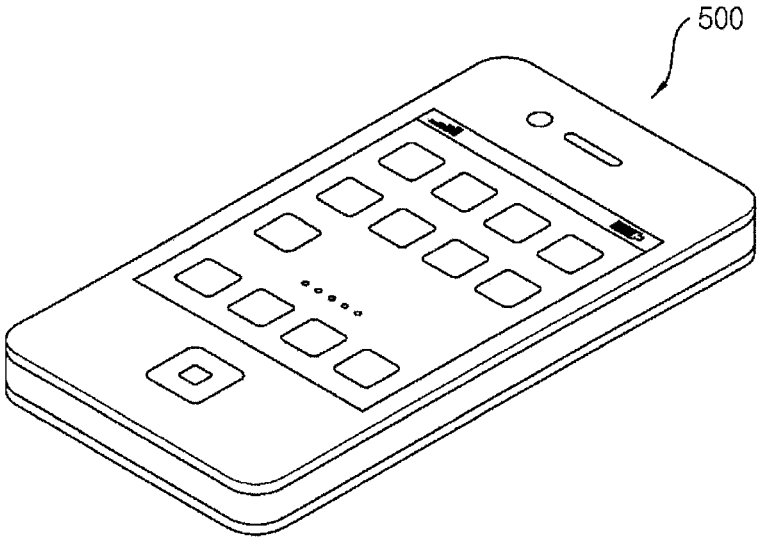
FIG. 15 is a diagram illustrating an example in which the electronic device of FIG. 13 is implemented as a smart phone.

FIG. 13 is a block diagram illustrating an electronic device according to example embodiments. FIG. 14 is a diagram illustrating an example in which the electronic device of FIG. 13 is implemented as a television. FIG. 15 is a diagram illustrating an example in which the electronic device of FIG. 13 is implemented as a smart phone.

Referring to FIGS. 13 through 15, the electronic device 500 may include a processor 510, a memory device 520, a storage device 530, an input/output (I/O) device 540, a power supply 550, and a display device 560. Here, the display device 560 may correspond to a display device 100 of FIG. 1. In some example embodiments, the display device 560 may be an organic light emitting display device. In addition, the electronic device 500 may further include a plurality of ports for communicating with a video card, a sound card, a memory card, a universal serial bus (USB) device, other electronic devices, etc. In an example embodiment, as illustrated in FIG. 14, the electronic device 500 may be implemented as a television. In another example embodiment, as illustrated in FIG. 15, the electronic device 500 may be implemented as a smart phone. However, the electronic device 500 is not limited thereto. For example, the electronic device 500 may be implemented as a cellular phone, a video phone, a smart pad, a tablet PC, a car navigation system, a computer monitor, a laptop, a head mounted display (HMD), etc.

The processor 510 may perform various computing functions. The processor 510 may be a micro processor, a central processing unit (CPU), an application processor (AP), etc. The processor 510 may be coupled to other components via an address bus, a control bus, a data bus, etc. Further, the processor 510 may be coupled to an extended bus such as a peripheral component interconnection (PCI) bus. The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 530 may be a solid state drive (SSD) device, a hard disk drive (HDD) device, a CD-ROM device, etc. The I/O device 540 may include an input device such as a keyboard, a keypad, a mouse device, a touch pad, a touch-screen, etc and an output device such as a printer, a speaker, etc. The power supply 550 may provide power for operations of the electronic device 500. In some example embodiments, the display device 560 may be included in the I/O device 540.

The display device 560 may be coupled to other components via the buses or other communication links. As described above, the display device 560 may accurately perform degradation compensation for a display panel and may allow a viewer not to recognize (e.g., observe or perceive) a degradation sensing operation performed on the display panel by selecting sensing target regions based on respective degradation degrees of local regions of the display panel, by determining sensing priorities between the sensing target regions based on respective degradation degrees and respective sensing waiting times of the local regions of the display panel, and by controlling the sensing target regions to be sequentially sensed only during a sensing execution time according to the sensing priorities.

To this end, the display device 560 may include the display panel having pixels, a scan driving unit that provides a scan signal to the display panel, a data driving unit that provides a data signal to the display panel, a driving control unit that controls the scan driving unit and the data driving unit, a temperature sensing unit that senses local temperatures of local regions of the display panel using at least one temperature sensor located on the display panel and generates temperature sensing information indicating the local temperatures, a current sensing unit that senses driving currents of the local regions and generates current sensing information indicating the driving currents, a sensing control unit that controls the temperature sensing unit and the current sensing unit to select sensing target regions based on respective degradation degrees of the local regions, to determine sensing priorities between the sensing target regions, and to control the sensing target regions to be sequentially sensed only during a sensing execution time according to the sensing priorities, and a degradation compensating unit that performs degradation compensation for the local regions based on respective degradation degrees of the local regions.

Here, the sensing control unit included in the display device 560 may include a sensing region selection block that selects the sensing target regions based on accumulated data of the temperature sensing information and the current sensing information and degradation expectation information according to an image to be displayed on the display panel, a timer block that measures respective sensing waiting times corresponding to a time elapsed from a previous time point at which each of the sensing target regions was sensed, a sensing priority determination block that determines the sensing priorities between the sensing target regions based on the degradation degrees and the sensing waiting times of the local regions, and a sensing execution block that controls the sensing target regions to be sequentially sensed only during the sensing execution time according to the sensing priorities. For example, the temperature sensing unit and the current sensing unit may be controlled by the sensing execution block. Because structures and operations of the display panel 560 are described above, duplicated description will not be repeated.

The present inventive concept may be applied to a display device (e.g., an organic light emitting display device) and an electronic device including the display device. For example, the present inventive concept may be applied to a cellular phone, a smart phone, a video phone, a smart pad, a smart watch, a tablet PC, a car navigation system, a television, a computer monitor, a laptop, a head mounted display (HMD), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and aspects of the present invention. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel comprising a plurality of pixels;

a scan driver configured to provide a scan signal to the display panel;

a data driver configured to provide a data signal to the display panel;

a driving controller configured to control the scan driver and the data driver;

a temperature sensor configured to sense local temperatures of local regions of the display panel using at least one temperature sensor located on the display panel and to generate temperature sensing information indicating the local temperatures;

a current sensor configured to sense driving currents of the local regions and to generate current sensing information indicating the driving currents; and a sensing controller circuit configured to control the temperature sensor and the current sensor to select sensing target regions among the local regions based on respective degradation degrees of the local regions that are determined based on accumulated data of the temperature sensing information corresponding to the local regions, accumulated data of the current sensing information corresponding to the local regions, and degradation expectation information according to an image to be displayed on the display panel, to determine sensing priorities between the sensing target regions, and to control the sensing target regions to be sequentially sensed only during a sensing execution time according to the sensing priorities between the sensing target regions.

2. The display device of claim 1, further comprising:

a degradation compensator configured to perform degradation compensation for the local regions based on the degradation degrees.

3. The display device of claim 1, wherein the sensing controller circuit comprises:

a sensing region selection circuit configured to select the sensing target regions based on the accumulated data of the temperature sensing information, the accumulated data of the current sensing information, and the degradation expectation information;

a timer circuit configured to measure respective sensing waiting times corresponding to a time elapsed from a previous time point at which each of the sensing target regions was sensed;

a sensing priority determination circuit configured to determine the sensing priorities between the sensing target regions based on the degradation degrees and the sensing waiting times; and a sensing execution circuit configured to control the temperature sensor and the current sensor to control the sensing target regions to be sequentially sensed only during the sensing execution time according to the sensing priorities between the sensing target regions.

4. The display device of claim 3, wherein the sensing region selection circuit is configured to select a first local region having an average local temperature that is higher than a predetermined reference temperature as the sensing target region.

5. The display device of claim 4, wherein the sensing region selection circuit is configured to select a second local region having an average driving current that is greater than a predetermined reference current as the sensing target region.

6. The display device of claim 5, wherein the sensing region selection circuit is configured to select a third local region having an image change that is smaller than a predetermined reference change as the sensing target region.

7. The display device of claim 6, wherein the sensing region selection circuit is configured to change the sensing target regions in real-time.

8. The display device of claim 6, wherein the sensing region selection circuit is configured to change the sensing target regions at an interval of a predetermined time.

9. The display device of claim 6, wherein the sensing region selection circuit is configured to change the sensing target regions at an interval of a predetermined number of times a degradation sensing operation is performed.

10. The display device of claim 6, wherein the sensing region selection circuit is configured to select a fourth local region having the average local temperature that is lower than the predetermined reference temperature, having the average driving current that is smaller than the predetermined reference current, and having the image change that is greater than the predetermined reference change as the sensing target region.

11. The display device of claim 10, wherein the sensing priority of the fourth local region selected as the sensing target region is determined to be lower than the sensing priorities of the first through third local regions selected as the sensing target regions.

12. The display device of claim 3, wherein the timer circuit is configured to initialize the sensing waiting times of the sensing target regions to be zero when each of the sensing target regions is sensed and to increase the sensing waiting times of the sensing target regions as the display panel operates.

13. The display device of claim 12, wherein the sensing priority determination circuit is configured to define first through (j)th sensing waiting groups, where j is an integer greater than or equal to 2, and to determine the sensing priority of an (n−1)th sensing waiting group to be higher than the sensing priority of an (n)th sensing waiting group, where n is an integer between 2 and j.

14. The display device of claim 13, wherein the sensing priority determination circuit is configured to classify the sensing target regions into first through (k)th sensing target groups, where k is an integer greater than or equal to 2, and to determine the sensing priority of an (m−1)th sensing target group to be higher than the sensing priority of an (m)th sensing target group, where m is an integer between 2 and k.

15. The display device of claim 14, wherein the sensing execution circuit is configured to control the sensing target regions to be sequentially sensed in the order of first through (j)th sensing waiting groups, and wherein the sensing execution circuit is configured to control the sensing target regions included in the same sensing waiting group to be sequentially sensed in the order of first through (k)th sensing target groups.

16. The display device of claim 15, wherein the sensing execution circuit is configured to perform a degradation sensing operation on the sensing target regions when the display panel is powered on or off.

17. A method of driving a display device, the method comprising:

sensing local temperatures of local regions of a display panel to generate temperature sensing information indicating the local temperatures;

sensing driving currents of the local regions to generate current sensing information indicating the driving currents;

selecting sensing target regions among the local regions based on respective degradation degrees of the local regions that are determined based on accumulated data of the temperature sensing information corresponding to the local regions, accumulated data of the current sensing information corresponding to the local regions, and degradation expectation information according to an image to be displayed on the display panel;

measuring respective sensing waiting times corresponding to a time elapsed from a previous time point at which each of the sensing target regions was sensed;

determining sensing priorities between the sensing target regions based on the degradation degrees and the sensing waiting times; and sequentially sensing the sensing target regions only during a sensing execution time according to the sensing priorities between the sensing target regions.

18. The method of claim 17, wherein determining the sensing priorities between the sensing target regions comprises:

defining first through (j)th sensing waiting groups, where j is an integer greater than or equal to 2;

determining the sensing priority of an (n−1)th sensing waiting group to be higher than the sensing priority of an (n)th sensing waiting group, where n is an integer between 2 and j;

classifying the sensing target regions into first through (k)th sensing target groups, where k is an integer greater than or equal to 2; and determining the sensing priority of an (m−1)th sensing target group to be higher than the sensing priority of an (m)th sensing target group, where m is an integer between 2 and k.

19. The method of claim 18, wherein determining the sensing priorities between the sensing target regions further comprises:

putting the sensing priorities between the first through (j)th sensing waiting groups before the sensing priorities between the first through (k)th sensing target groups.

20. The method of claim 17, wherein sensing the sensing target regions comprises:

detecting that the display panel is powered on or off; and performing a degradation sensing operation on the sensing target regions when the display panel is powered on or off.

* * * * *